US006125770A

United States Patent [19]

Brandenburg

[11] Patent Number: 6,125,770

[45] Date of Patent: Oct. 3, 2000

[54] PLASTIC PALLET

[75] Inventor: Klaus-Dieter Brandenburg, Herzebrock-Clarholz, Germany

[73] Assignee: Paul Craemer GmbH, Herzebrock, Germany

[21] Appl. No.: 09/370,821

[22] Filed: Aug. 9, 1999

[51] Int. Cl.[7] ..... B65D 19/38

[52] U.S. Cl. ..... 108/57.25

[58] Field of Search ..... 108/57.25, 57.26, 108/51.11, 901, 902

[56] References Cited

U.S. PATENT DOCUMENTS

| | | | |
|---|---|---|---|
| 1,770,614 | 7/1930 | Hennessy | 108/57.25 |
| 5,117,762 | 6/1992 | Shuert | 108/57.25 |
| 5,402,735 | 4/1995 | DeJean | 108/57.25 X |
| 5,404,829 | 4/1995 | Shuert | 108/57.26 |
| 5,413,052 | 5/1995 | Breezer et al. | 108/57.25 X |
| 5,791,262 | 8/1998 | Knight et al. | 108/57.25 |
| 5,845,588 | 12/1998 | Gronnevik | 108/57.25 X |
| 5,868,080 | 2/1999 | Wyler et al. | 108/57.25 |
| 5,890,437 | 4/1999 | Hill | 108/51.11 X |
| 5,894,803 | 4/1999 | Kuga | 108/57.25 X |

*Primary Examiner*—Jose V. Chen
*Attorney, Agent, or Firm*—Henry M. Feiereisen

[57] ABSTRACT

A load-bearing plastic pallet, includes an pallet deck having a top surface, and stringers connected in one piece to the pallet deck and so positioned underneath the pallet deck as to form inlet channels for allowing engagement of forks of a fork lift. Insertable in the pallet deck are optional reinforcement members which reduce a flexure of the pallet deck and are held in place in positive and/or non-positive manner by retention members. The retention members are positioned underneath cover boards which are flush-mounted to the top surface of the pallet deck and extend from one cross side to an opposite other cross side.

8 Claims, 3 Drawing Sheets

PLASTIC PALLET

BACKGROUND OF THE INVENTION

The present invention relates, in general, to a plastic pallet, and more particularly to a load-bearing plastic pallet of a type including a pallet deck, stringers which are so arranged to the pallet deck as to form insert channels for allowing engagement of forks of a fork lift, and optional reinforcement members for reducing a flexure of the pallet.

It is known to manufacture the pallet deck and the stringers or bottom part of a pallet separately from one another and to join these components together to form a tight composite, after reinforcement members have been inserted in respective receiving channels. The receiving channels are open to the side of the pallet so that moisture, dirt and the like can penetrate. Thus, such conventional pallets, which can also be designed as so-called Euro pallets with dimensions of 120×80 cm, are unsuitable for use in hygienic areas, e.g., for transport of meat. Moreover, these pallets are difficult to manufacture as at least two tools are required to produce both components, and subsequently these two components must be joined together, for example through welding.

SUMMARY OF THE INVENTION

It is thus an object of the present invention to provide an improved plastic pallet, obviating the afore-stated drawbacks.

In particular, it is an object of the present invention to provide an improved plastic pallet which meets hygienic demands and is fully recyclable while yet is inexpensive to manufacture.

These objects, and others which will become apparent hereinafter, are attained in accordance with the present invention by providing a pallet deck having a top surface, stringers connected in one piece to the pallet deck and so positioned underneath the pallet deck as to form inlet channels for allowing engagement of forks of a fork lift, cover boards flush-mounted to the top surface and extending from one cross side to an opposite other cross side, and retention members positioned underneath the cover boards for securement in positive or non-positive manner of optional reinforcement members, for reducing a flexure of the pallet deck.

As a result of a single-piece construction of the pallet deck and the stringers, the plastic pallet can be manufactured by a single tool through injection molding. Thus, the application of joining techniques required heretofore and fairly complicated to ensure that both components can withstand loads in the joining area, are eliminated. The cover boards have the advantage that following a manufacture of the pallet deck and the stringers, the reinforcement members can be placed in the area beneath the cover boards in respective compartments, in the event a customer exercises the option to have reinforcement members installed when purchasing a new pallet.

The reinforcement members may be placed before or after attachment of the cover boards to the pallet deck in the compartments. After their placement, the cover boards are connected to the pallet deck, preferably by welding or bonding. Thus, it is possible to provide a completely sealed compartment, e.g. by sealing the compartment ends with a cap or other closure element, so as to realize a plastic pallet that can meet hygienic demands because, for example, cleaning agents or the like are prevented from penetrating the compartments positioned beneath the cover boards. In addition, moisture cannot seep in, so that the reinforcement members may be made of steel as the risk of rust is eliminated.

The placement of the optional reinforcement members in the pallet deck is, in general, advantageous because in situations where the plastic pallet is subject to bending forces, the reinforcement members are subject to tensile loads so that a particularly significant stiffening effect is realized.

As a result of the flush-mounted attachment of the cover boards, the pallet deck exhibits, practically, a smooth loading area which is free of any protrusions.

According to another feature of the present invention, the cover boards are made of two superimposed layers of plastics which are different but belong to a same material type, whereby the stringer-distal upper layer has a hardness that is smaller than the hardness of the stringer-proximal lower layer, and a coefficient of friction which is greater than a coefficient of friction of the lower layer. The lower layer is suitably made of a same material as the single-piece plastic pallet, e.g. of common polyethylene, whereas the upper layer is made of soft polyethylene. The lower layer can easily be welded to adjoining webs or areas of the pallet deck. During later disposal, the plastic pallet can easily be recycled as the upper layers of the cover boards belong to the same plastic type. Moreover, the share of the upper layers is fairly small in comparison to the whole material. As a consequence of a softer composition of the upper layer with respect to the lower layer, the coefficient of friction is increased so that objects placed on the pallet are less likely, or even prevented, to slide.

Despite the different materials, the cover boards can easily be made, for example, through coextrusion, whereby required sections are severed from an endless strand. Suitably, the plastic pallet has openings at least on one side, preferably at the shorter cross side (in the event of a Euro pallet or other rectangular pallet), in registry with the retention members for the reinforcement members so as to allow insertion and withdrawal of the reinforcement members. These openings enable, if necessary, to subsequently equip a plastic pallet with reinforcement members so that a removal of the cover boards and subsequent reattachment through welding is unnecessary. During later disposal, the reinforcement members, which are normally made of steel, can be withdrawn through the openings before recycling of the plastic pallet, whereby there is no need to remove the cover boards.

Suitably, the openings are closeable by a closure element, e.g. a plug, as the plastic pallet is intended also for use in hygienic areas, whereby the plug may be removed, if necessary. Suitably, each opening is then provided with a threaded bore for threaded engagement with an external thread of the plug. To avoid the closure element or plug from projecting with respect to adjoining areas, the threaded bore is formed with a counterbore to the outside for receiving a flanged part of the closure element. At the lower side, the surfaces of the plastic pallet extend at an angle relative to one another. Suitably the individual surfaces are smooth. In order to realize an increased resistance to bending, it may be suitable to provide the pallet deck with pockets in certain areas. The pockets are bounded by side walls or webs which significantly reinforce the plastic pallet. Moreover, the manufacture is simplified because the rams can be introduced from above into the mold during injection. The reinforcement members may be made from typical profiles, e.g. round bars, T beams, double T beams and the like. As the reinforcement members are placed in an enclosed compartment, there is no need for a particular protection against corrosion.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
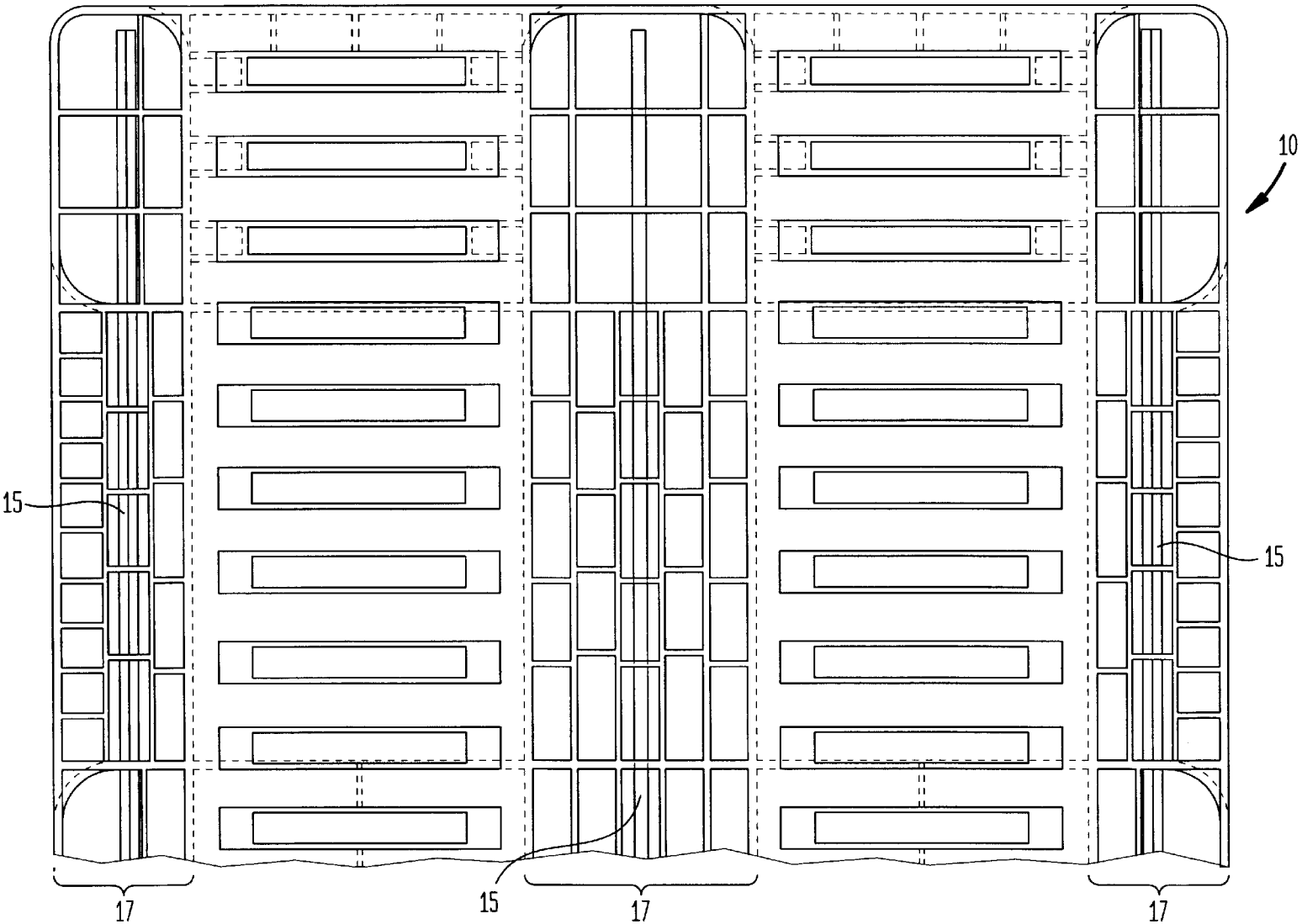
FIG. 1 is a partial top plan view of a plastic pallet according to the present invention, without illustration of cover boards.

Throughout all the Figures, same or corresponding elements are generally indicated by same reference numerals.

Figure 2:
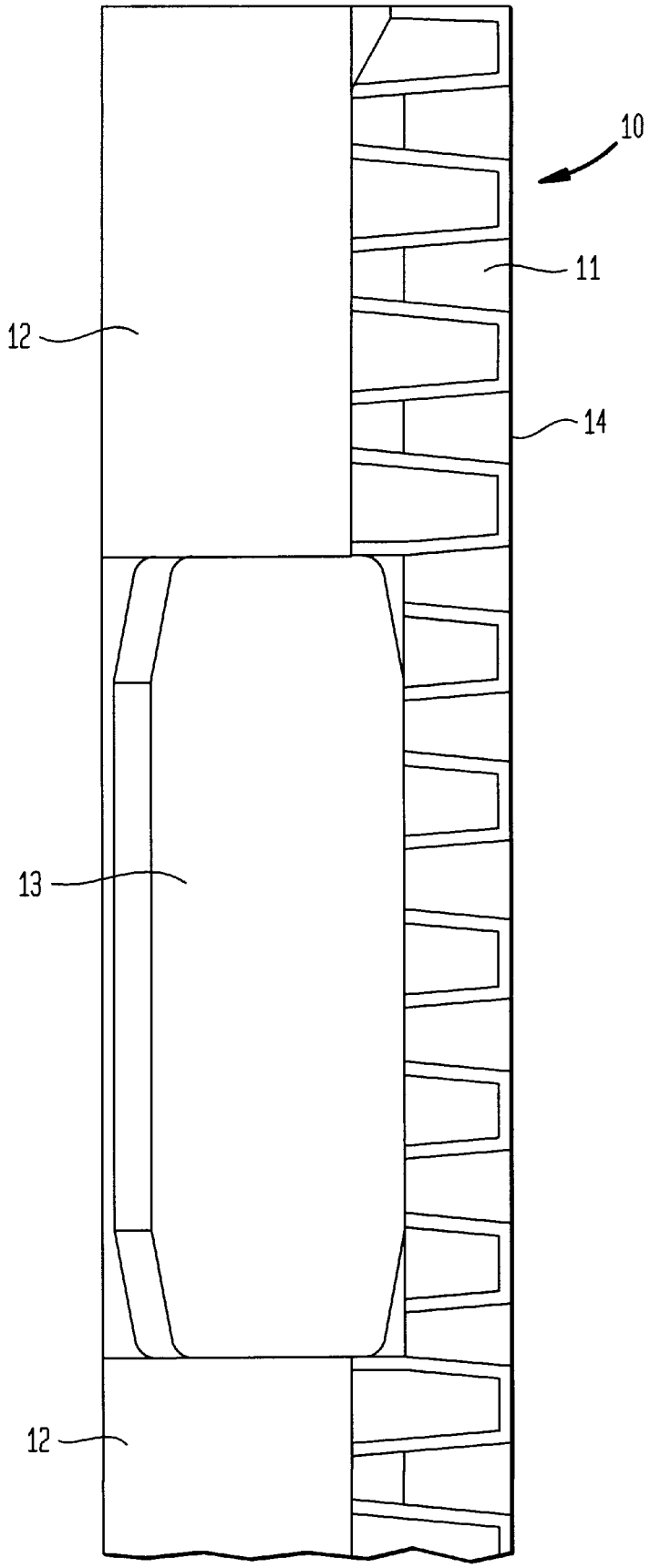
FIG. 2 is a partial side view of the plastic pallet of FIG. 1.

Turning now to the drawing, and in particular to FIGS. 1 and 2, there are shown a partial top plan view and a side view of a plastic pallet according to the present invention, generally designated by reference numeral 10 and having, for example, a typical size of 120×80 cm. The plastic pallet 10 includes a pallet deck 11, which forms the top part, and stringers 12, which form the bottom part. The stringers 12 are so positioned and spaced apart as to form inlet channels 13 so that the plastic pallet 10 can receive the insertion of the fork of a fork lift from any of its four sides. For sake of simplicity, FIG. 2 shows only one inlet channel 13.

The bottom areas of the plastic pallet 10 extend at an angle to one another and have a smooth surface. The pallet deck 11 defines a loading platform 14 and includes open-topped pockets or recesses which taper in the direction of the stringers 12.

As shown in FIG. 1, the pallet deck 11 is reinforced by three reinforcement members or slats 15 to reduce a flexure of the pallet 10. The reinforcement members 15 are made of steel and are placed at a slight distance to the loading platform 14 in relation to the overall height of the plastic pallet 10, as shown, for example, in FIG. 3. Suitably, the reinforcement members 15 extend from a shorter cross side of the plastic pallet 10 to the opposite cross side.

Figure 3:
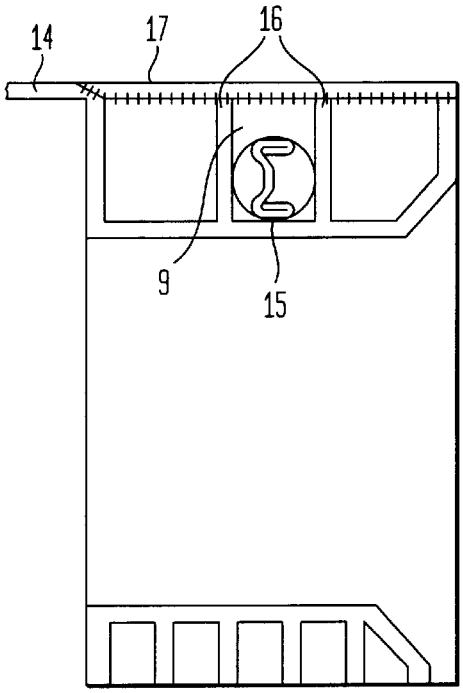
FIG. 3 is a cutaway side view of the plastic pallet of FIG. 1 with inserted reinforcement member.

As shown in FIG. 3, the reinforcement members 15 are configured as railroad rail sections and received in a form-fitting or positive manner in compartments or channels 9 formed by retention members 16 or ribs. Persons skilled in the art will understand that the rail section configuration is shown by way of example only, as other cross sectional shapes are certainly within the scope of the present invention. The axial ends of the channels 9 are open at the longitudinal sides of the pallet deck 11 so that the reinforcement members 15 can be withdrawn from the pallet deck 11 before recycling the pallet 10, or can be inserted into the pallet deck 11, when, for example, the plastic pallet 10 should be equipped with reinforcement members 15.

As further shown in FIG. 3 in conjunction with FIG. 1, the pallet deck 11 is provided with spaced-apart cover boards 17 which extend from one cross side to the opposite other cross side, whereby the cover boards 17 are flush-mounted to the pallet deck 11 so that the loading platform 14 is smooth.

The pallet deck 11 and the stringers 12 are made in the non-limiting example of FIG. 1 of single-piece configuration and thus can be manufactured by a single tool through injection molding. In the area of the cover boards 17, the pallet deck 11 is suitably recessed to allow the flush-mounted attachment of the cover boards 17.

As indicated in FIG. 3, the cover boards 17 can be welded subsequently onto the pallet deck 11 with adjoining webs or surfaces. Welding of the cover boards 17 may be executed before or after placement of the reinforcement members 15 in the retention elements 16. Thus, in the event, inclusion of the optional reinforcement members 15 is desired, the reinforcement members 15 are placed in the channels 9 and subsequently the cover boards 17 are welded to the pallet deck 11.

The cover boards 17 are made from two layers in superimposed disposition, with the bottom layer, which confronts the stringers 12 being made of a same material, for example polyethylene, as the plastic pallet 10. The top layer is made of a softer material, e.g. soft polyethylene. Thus, the coefficient of friction is significantly increased. The cover boards 17 can be made through coextrusion in a single working cycle and severed from an endless strand. During recycling of the plastic pallet 10, it is thus only necessary to remove the reinforcement members 15 whereas the cover boards 17 remain in place, as the top layer is made of a same material as the pallet deck 11.

Figure 6:
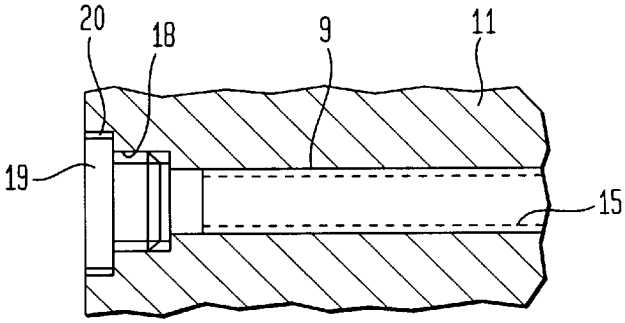
FIG. 6 is a cutaway view of the plastic pallet, illustrating in detail the securement of the reinforcement members.

The openings at the ends of the channels 9 for the reinforcement members 15 are suitably designed as bores with internal threads 18 and closed by a plug 19, as shown in FIG. 6. The threaded bore may have a counterbore 20 to the outside for placement of a flange of the plug. Regardless of the configuration, it should, however, be assured that no edges and protrusions are formed in view of the use of the plastic pallet 10 i.a. in hygienic areas where they are subject to cleaning agents and disinfectants.

Figure 4:
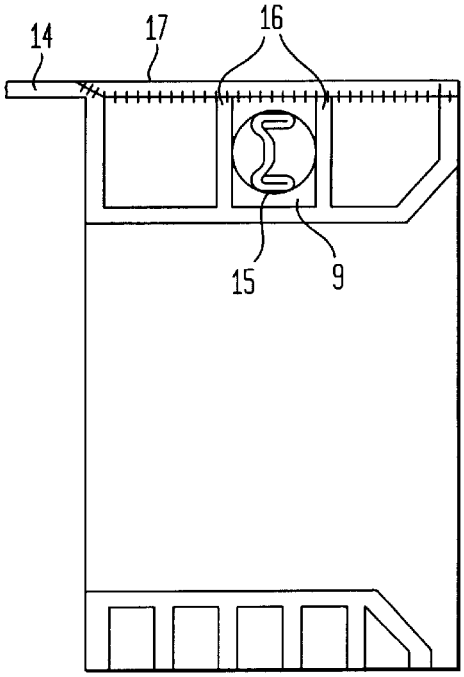
FIG. 4 is a side view similar to FIG. 3, with modified placement of the reinforcement member.
Figure 5:
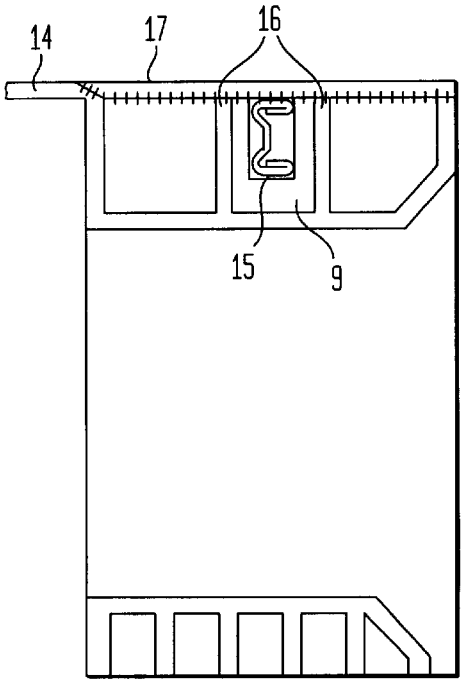
FIG. 5 is a side view similar to FIG. 3 with still another variation of placement of the reinforcement member.

In FIG. 3, the reinforcement members 15 are positioned at a slight distance to the cover boards 17. FIGS. 4 and 5 show variations of the positioning of the reinforcement members 15, with FIG. 4 showing the reinforcement members 15 in a disposition at half the distance to the cover boards 17 compared to the disposition in FIG. 3. In FIG. 5, the reinforcement members 15 are positioned between the ribs 16 and contact the cover boards 17 with their upper surface.

While the invention has been illustrated and described as embodied in a plastic pallet, it is not intended to be limited to the details shown since various modifications and structural changes may be made without departing in any way from the spirit of the present invention.

What is claimed as new and desired to be protected by Letters Patent is set forth in the appended claims:

1. A load-bearing plastic pallet, comprising a pallet deck having a top surface;

stringers connected in one piece to the pallet deck and so positioned underneath the pallet deck as to form inlet channels for allowing engagement of forks of a fork lift;

cover boards flush-mounted to the top surface of the pallet deck and extending from one cross side to an opposite other cross side;

retention means positioned underneath the cover boards and having a compartment; and a reinforcement member received in at least one of positive and non-positive manner in the compartment for reducing a flexure of the pallet deck.

2. The plastic pallet of claim 1 wherein the pallet deck has a rectangular configuration defined by two opposite longitudinal sides and two opposite cross sides which are shorter than the longitudinal sides, said cover boards extending between the cross sides.

3. The plastic pallet of claim 1 wherein each of the cover boards includes two superimposed layers of plastics which are different but belong to a same material type, with a stringer-distal top layer and a stringer-proximal bottom layer, said top layer having a hardness which is smaller than a hardness of the bottom layer, and a coefficient of friction which is greater than a coefficient of friction of the bottom layer.

4. The plastic pallet of claim 1 wherein the cover boards are made through coextrusion.

5. The plastic pallet of claim 1 having at least on one side an opening in registry with the compartment of the retention means for insertion and withdrawal of the reinforcement member.

6. The plastic pallet of claim 5 wherein the opening is formed as threaded bores for receiving a closure element.

7. The plastic pallet of claim 5 wherein the opening has a counterbore on an outer side, for engagement of a flange of the closure element.

8. The plastic pallet of claim 1 wherein the pallet deck has a smooth underside and includes open-topped pockets bounded by side walls.

* * * * *